US008505437B2

(12) United States Patent
Nishi

(10) Patent No.: US 8,505,437 B2
(45) Date of Patent: Aug. 13, 2013

(54) FLUID PRESSURE CYLINDER

(75) Inventor: Takanori Nishi, Tsukubamirai (JP)

(73) Assignee: SMC Kabushiki Kaisha, Tokyo (JP)

( * ) Notice: Subject to any disclaimer, the term of this patent is extended or adjusted under 35 U.S.C. 154(b) by 765 days.

(21) Appl. No.: 12/675,938

(22) PCT Filed: Aug. 22, 2008

(86) PCT No.: PCT/JP2008/065472

§ 371 (c)(1),
(2), (4) Date: Mar. 1, 2010

(87) PCT Pub. No.: WO2009/034852

PCT Pub. Date: Mar. 19, 2009

(65) Prior Publication Data

US 2010/0212491 A1 Aug. 26, 2010

(30) Foreign Application Priority Data

Sep. 11, 2007 (JP) ..... 2007-235746

(51) Int. Cl.
*F15B 15/22* (2006.01)

(52) U.S. Cl.
USPC ..... 92/85 R; 92/177

(58) Field of Classification Search
USPC ..... 92/85 R, 169.1, 177
See application file for complete search history.

(56) References Cited

U.S. PATENT DOCUMENTS

| | | | | |
|---|---|---|---|---|
| 3,465,650 | A * | 9/1969 | Gluck | 92/85 R |
| 3,961,564 | A | 6/1976 | Rich et al. | |
| 4,896,584 | A | 1/1990 | Stoll et al. | |

FOREIGN PATENT DOCUMENTS

| | | | |
|---|---|---|---|
| DE | 295 01 243 | | 4/1995 |
| DE | 29501243 | U1 * | 4/1995 |
| GB | 887 473 | | 1/1962 |
| GB | 2 278 642 | | 12/1994 |
| JP | 50-35990 | | 4/1975 |
| JP | 57-96807 | | 6/1982 |
| JP | 7 34239 | | 6/1995 |
| JP | 9 303320 | | 11/1997 |
| JP | 9303320 | * | 11/1997 |

OTHER PUBLICATIONS

German Office Action issued Sep. 8, 2011, in Patent Application No. 112008002320.4.
Office Action issued on Sep. 6, 2011 in the corresponding Japanese Patent Application No. 2007-235746 (with the English translation of pertinent portion).

* cited by examiner

*Primary Examiner* — Edward Look
*Assistant Examiner* — Logan Kraft
(74) *Attorney, Agent, or Firm* — Oblon, Spivak, McClelland, Maier & Neudstadt, L.L.P.

(57) ABSTRACT

A fluid pressure cylinder including a first damper and a second damper provided respectively on a head cover and a rod cover, which are disposed on both ends of the fluid pressure cylinder so as to face toward a piston. The first damper and the second damper are formed from an elastic material, and are made up from a main body portion against which the piston abuts, and a plurality of legs that project from the main body portion and which are gripped between the head cover and the rod cover and an inner wall surface of the cylinder tube.

12 Claims, 14 Drawing Sheets

FLUID PRESSURE CYLINDER

TECHNICAL FIELD

The present invention relates to a fluid pressure cylinder, in which a piston is displaced in an axial direction under the supply of a pressure fluid.

BACKGROUND ART

Heretofore, as a means for transporting a workpiece or the like, for example, a fluid pressure cylinder having a piston that is displaced under the supply of a pressure fluid has been known. With this type of fluid pressure cylinder, a structure is provided in which a piston is disposed displaceably inside a cylinder chamber, which is defined in the interior of a tubular shaped cylinder body, and together therewith, a head cover and a rod cover are mounted respectively onto both ends of the cylinder body, for thereby closing off and sealing the cylinder chamber.

With such a fluid pressure cylinder, the piston is disposed displaceably inside of the cylinder chamber defined in the interior of the tubular shaped cylinder body, and dampers are provided, which are capable of absorbing shocks produced when the piston abuts against the head cover and the rod cover disposed on both ends of the cylinder body.

The dampers, for example as disclosed in Japanese Laid-Open Utility Model Publication No. 07-034239, are formed from an elastic material such as rubber or the like, and are disposed on ends of the head cover and the rod cover facing toward both end surfaces of the piston. In addition, a structure is formed such that shocks are absorbed upon displacement of the piston along the cylinder body and abutment thereof against the dampers.

Further, in Japanese Laid-Open Patent Publication No. 09-303320, a structure is disclosed in which gaskets functioning as dampers are sandwiched between ends of the cylinder body and covers, and wherein shocks are absorbed upon displacement of the piston along the cylinder body and abutment thereof against the gaskets.

Incidentally, with the conventional technique according to Japanese Laid-Open Utility Model Publication No. 07-034239, when the piston abuts against the dampers, the dampers, which are formed from elastic materials, are compressed and deformed. At this time, along with deformation of the dampers, there is a concern that the mounted condition thereof with respect to the head cover and the rod cover may become released, resulting in detachment and falling off from the head cover and the rod cover.

On the other hand, with the conventional technique according to Japanese Laid-Open Patent Publication No. 09-303320, because gaskets are sandwiched between ends of the cylinder body and the covers, although falling off of the gaskets is prevented, due to the fact that the gaskets are pressed and fastened together between the cylinder tube and the head and rod cover, the ability to assemble (ease of assembly) of the device is lowered.

DISCLOSURE OF INVENTION

A general object of the present invention is to provide a fluid pressure cylinder in which ease of assembly of the dampers is enhanced, and which is capable of preventing falling off of the dampers inside the cylinder body.

For achieving the aforementioned object, the present invention is characterized by a cylinder body having a cylinder chamber defined therein, a piston that is disposed displaceably along an axial direction inside the cylinder chamber, a cover member accommodated inside the cylinder chamber for blocking and sealing the cylinder chamber, and a damper disposed on the cover member, which absorbs shocks when the piston abuts against the cover member, the damper comprising a main body portion that faces toward the piston, and a retaining member that extends perpendicularly to the main body portion and is engaged with a side surface of the cover member, wherein the retaining member is gripped between the side surface of the cover member and an inner wall surface of the cylinder body.

The above and other objects, features and advantages of the present invention will become more apparent from the following description when taken in conjunction with the accompanying drawings in which a preferred embodiment of the present invention is shown by way of illustrative example.

BEST MODE FOR CARRYING OUT THE INVENTION

Figure 1:
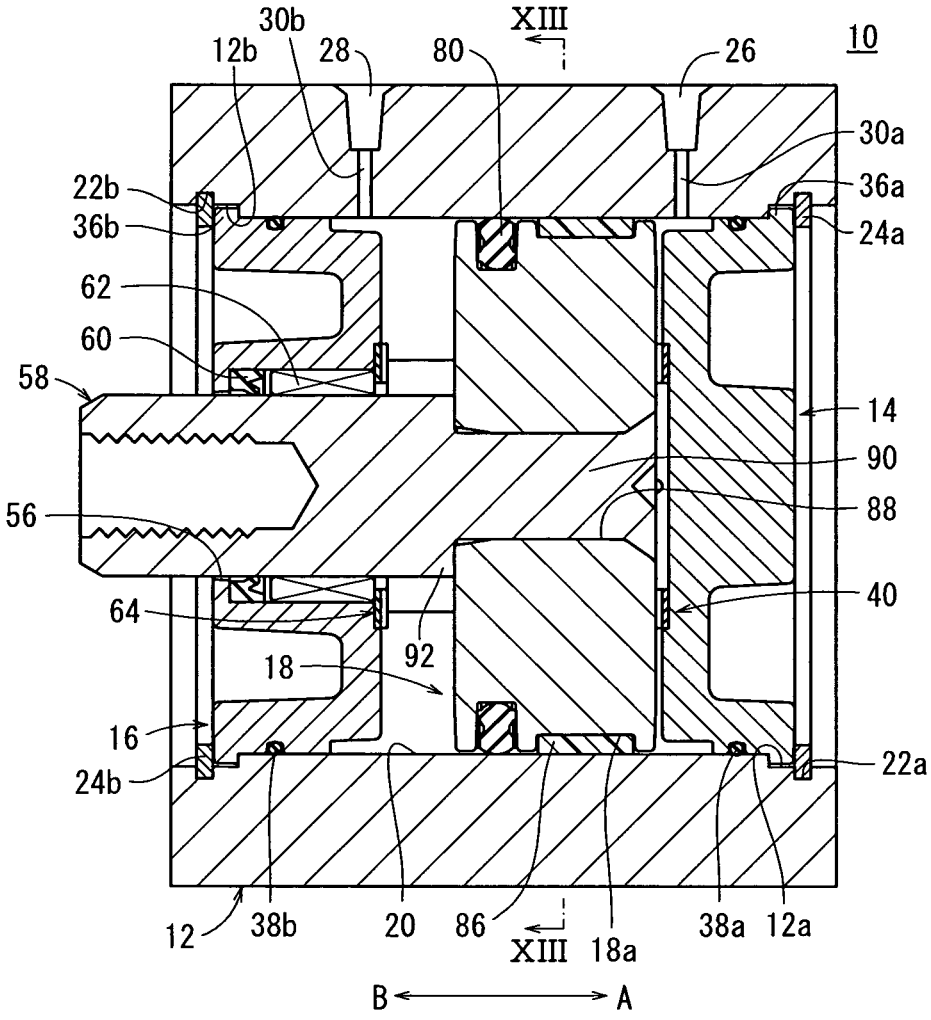
FIG. 1 is an overall vertical cross sectional view of a fluid pressure cylinder according to an embodiment of the present invention.

In FIG. 1, reference numeral 10 indicates a fluid pressure cylinder according to an embodiment of the present invention.

As shown in FIG. 1, the fluid pressure cylinder 10 includes a tubular shaped cylinder tube (cylinder body) 12, a head cover (cover member) 14 mounted on one end of the cylinder tube 12, a rod cover (cover member) 16 mounted on another end of the cylinder tube 12, and a piston 18, which is disposed displaceably in the interior of the cylinder tube 12.

A cylinder hole (cylinder chamber) 20, having an elliptical shape in cross section and which penetrates along the axial direction (the direction of arrows A and B), is formed in a center portion of the cylinder tube 12. The cylinder hole 20 is formed with an elliptical shape in cross section such that the major axis is oriented in the vertical direction. The cylinder hole 20 includes, on both end portions thereof, a pair of recesses 12*a*, 12*b*, which are expanded in width in a direction away from the center of the cylinder hole 20.

Further, ring grooves 22*a*, 22*b* are formed respectively on both ends of the cylinder hole 20 along an inner peripheral surface thereof at locations on opening sides with respect to the recesses 12*a*, 12*b*. Latching rings 24*a*, 24*b*, which are formed substantially U-shaped in cross section from a metallic material, are installed respectively in the ring grooves 22*a*, 22*b*.

On the other hand, first and second fluid ports 26, 28 for supplying and discharging a pressure fluid are formed on an outer side surface of the cylinder tube 12. The first and second fluid ports 26, 28 are separated from each other by a predetermined distance along the axial direction (the direction of arrows A and B) of the cylinder tube 12, and communicate respectively with the cylinder hole 20 through communication passages 30*a*, 30*b*. Owing thereto, fluid pressure supplied to the first and second fluid ports 26, 28 passes through the communication passages 30*a*, 30*b* and is introduced to the interior of the cylinder hole 20.

Figure 11:
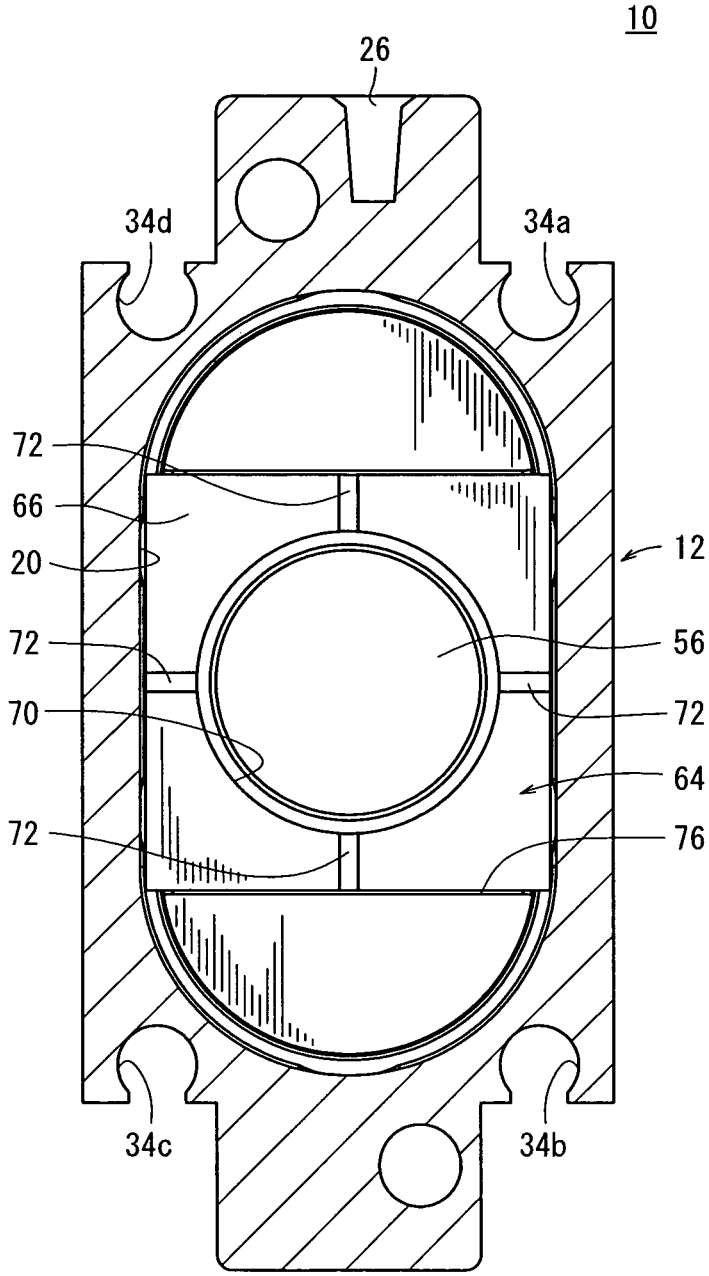
FIG. 11 is a cross sectional view showing an end portion of a cylinder tube on which the rod cover is mounted.
Figure 12:
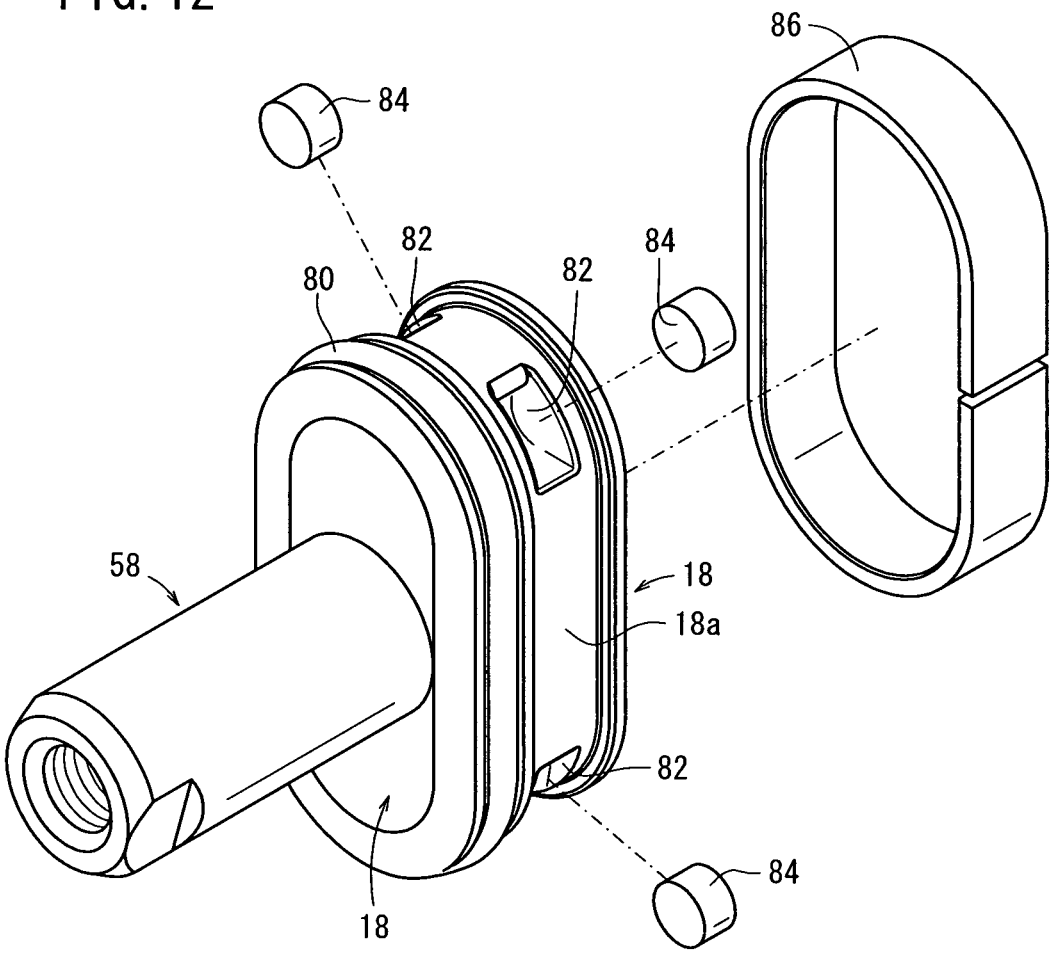
FIG. 12 is a partial exploded perspective view showing a state in which a magnetic body and a piston cover are detached and separated from a piston.
Figure 13:
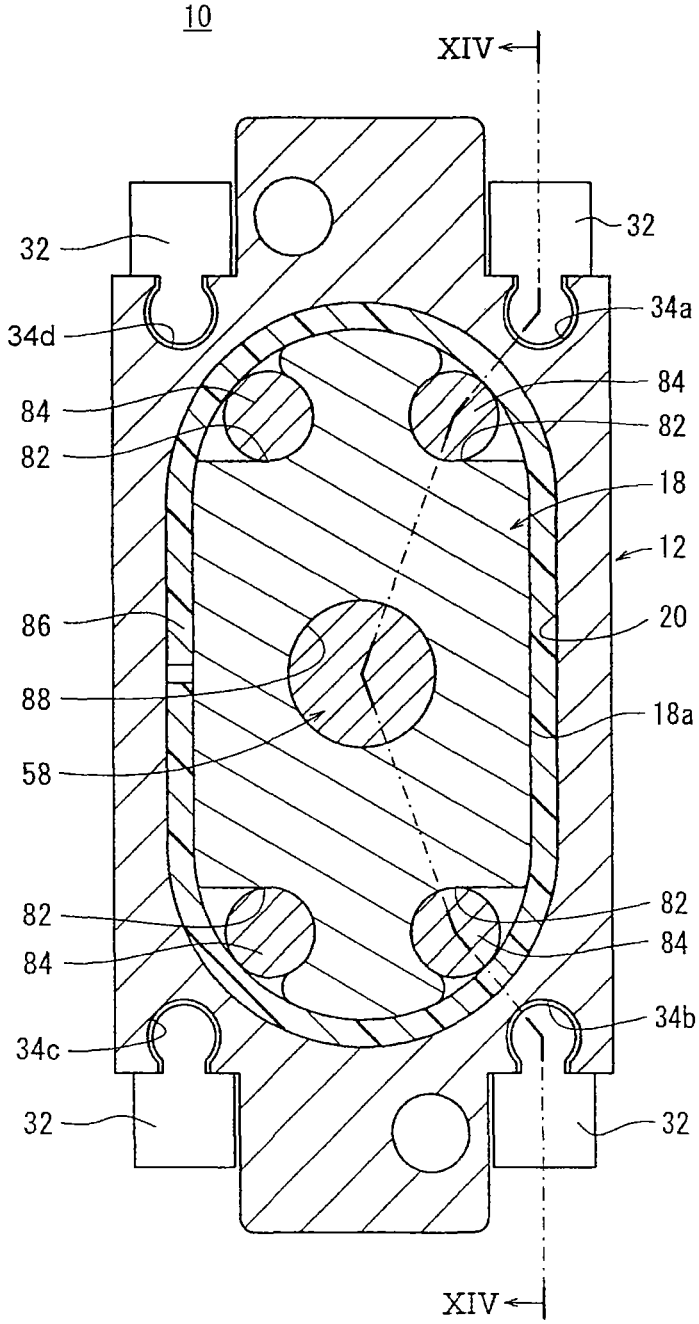
FIG. 13 is a cross sectional view taken along line XIII-XIII of FIG. 1.
Figure 14:
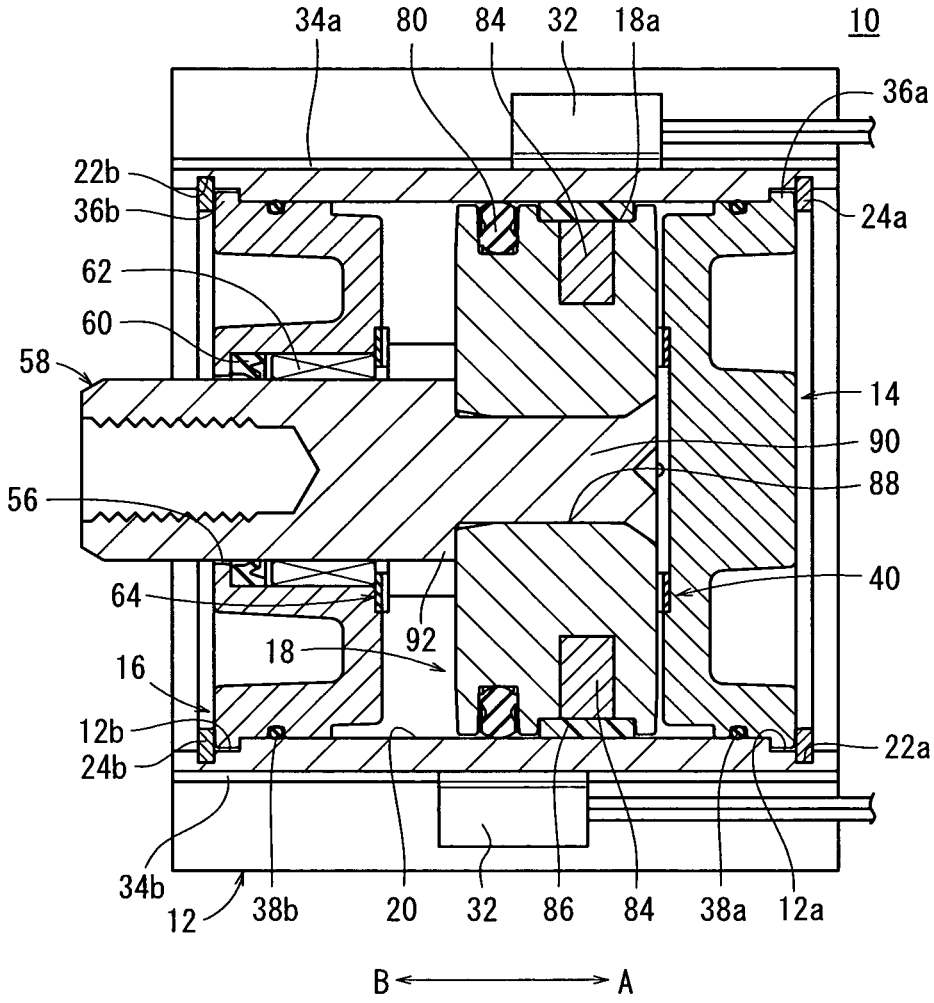
FIG. 14 is a cross sectional view taken along line XIV-XIV of FIG. 13.

Further, on the outer side surface of the cylinder tube 12, a plurality of sensor grooves 34*a* to 34*d* (see FIGS. 11 and 13) for installation of sensors 32 (see FIGS. 13 and 14) that are capable of detecting a position of the piston 18 are 5 arranged in a confronting manner centrally about the cylinder hole 20. The sensor grooves 34*a* to 34*d* extend respectively along the axial direction (the direction of arrows A and B). Stated otherwise, the plural sensor grooves 34*a* to 34*d* are disposed with a given mutual 10 separation from each other, so as to surround the cylinder hole 20.

As shown in FIGS. 1 through 6, the head cover 14 is formed, for example, from a metallic material such as aluminum or the like, and is installed on one end side (in the direction of the arrow A) of the cylinder tube 12. The head cover 14 is formed with a substantially elliptical shape in cross section, corresponding to the shape of the cylinder hole 20.

Figure 3:
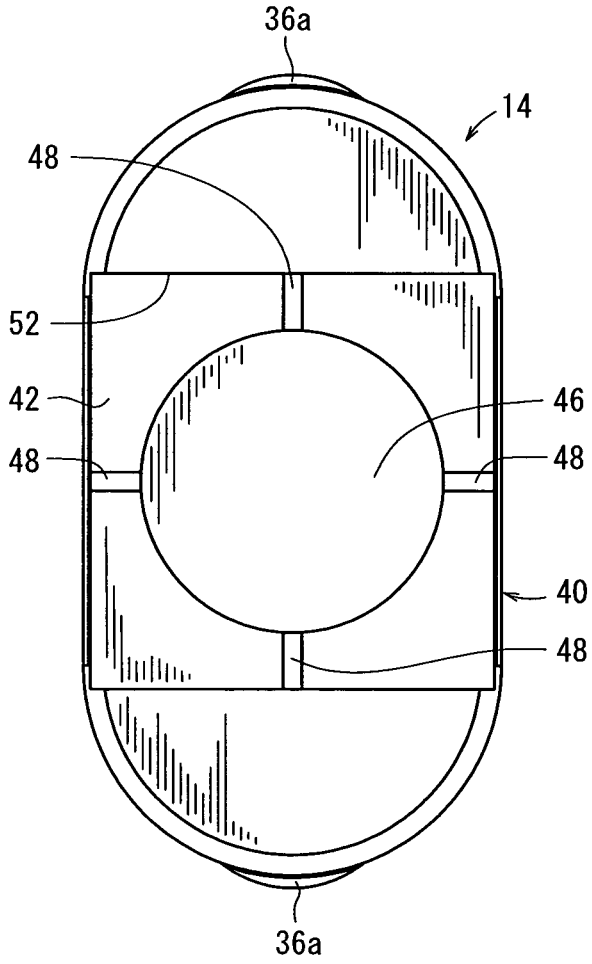
FIG. 3 is a frontal surface view of the head cover shown in FIG. 2.
Figure 4:
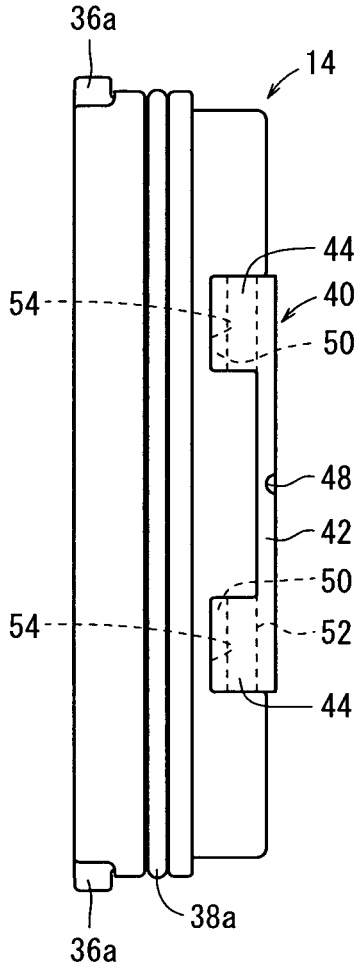
FIG. 4 is a side surface view of the head cover shown in FIG. 2.

On both side parts of the head cover 14, a pair of protrusions 36*a* are formed, which project a predetermined length from the outer peripheral surface at positions corresponding to the recesses 12*a* when the head cover 14 is installed into the cylinder hole 20 (see FIG. 3). The protrusions 36*a* are disposed on both side portions that are expanded outwardly in arcuate shapes on the head cover 14, and bulge at a given radius of curvature corresponding to the recesses 12*a*.

Further, an o-ring 38*a* is installed on the outer peripheral surface of the head cover 14 via an annular groove. When the head cover 14 is installed into the cylinder hole 20 of the cylinder tube 12, an airtight condition is maintained by abutment of the o-ring 38*a* against the inner peripheral surface of the cylinder hole 20.

Furthermore, a first damper (damper) 40 is mounted on another end portion of the head cover 14 that faces toward the cylinder hole 20.

The first damper 40 is formed, for example, from an elastic material such as rubber or the like or from a resin material, and comprises a main body portion 42 in the form of a plate having a constant thickness, which is mounted on the other end surface of the head cover 14, and a plurality of legs (retaining members) 44, which are joined substantially perpendicularly with respect to the main body portion 42 and are retained on the head cover 14.

The main body portion 42 is formed in a substantially flat state and includes a hole 46 with a predetermined radius formed in a center part thereof, together with substantially cross-shaped grooves 48, which are formed about the hole 46 as their center. The grooves 48 are formed on a side of one end surface of the main body portion 42 against which the piston 18 is capable of abutment, four of which are formed at 90° intervals with respect to the center of the hole 46, extending from the outer circumferential side of the hole 46 to the side edges of the main body portion 42. The form and number of the grooves 48 is not limited, insofar as the grooves 48 are connected between the side edges of the main body portion 42 and the hole 46.

The legs 44 are disposed respectively and individually in the vicinity of the four corners of the rectangular shaped main body portion 42. The legs 44 are formed so as to project by a predetermined length with respect to the other end surface of the main body portion 42.

More specifically, two legs 44 from among the four legs 44 are disposed on one side surface of the main body portion 42 while being separated by a predetermined distance, whereas the remaining two legs 44 are disposed on the other side surface of the main body portion 42 while also being separated by a predetermined distance. That is, the two pairs of legs 44 confront one another while sandwiching the main body portion 42 therebetween.

Claw portions 50, which are bent substantially perpendicularly toward directions that mutually approach each other, are provided on the ends of the legs 44. That is, the claw portions 50 are disposed in parallel, and are separated by a given distance, by the length of the legs 44, with respect to the main body portion 42.

On the other end portion of the head cover 14 on which the first damper 40 is mounted, a recess 52 is formed, of which a substantially center portion thereof is recessed in a rectangular shape, such that the main body portion 42 is mountable within the recess 52. Because the depth of the recess 52 is set to be narrower than the thickness of the main body portion 42, a portion of the main body portion 42 projects outwardly, just slightly with respect to the other end surface of the head cover 14 (see FIG. 4). More specifically, owing to the fact that the main body portion 42 making up the first damper 40 projects outwardly from the other end surface of the head cover 14, the piston 18 is prevented from directly contacting the head cover 14, and shocks imparted from the piston 18 with respect to the head cover 14 can be buffered.

Further, on the other end of the head cover 14, a plurality of claw grooves (engagement grooves) 54, which are separated by a predetermined distance, are formed on the side surfaces thereof. The claw portions 50 of the legs 44 are inserted into the claw grooves 54. The number and positioning of the claw grooves 54 are set to correspond to the legs 44 and the claw portions 50 of the first damper 40.

Figure 2:
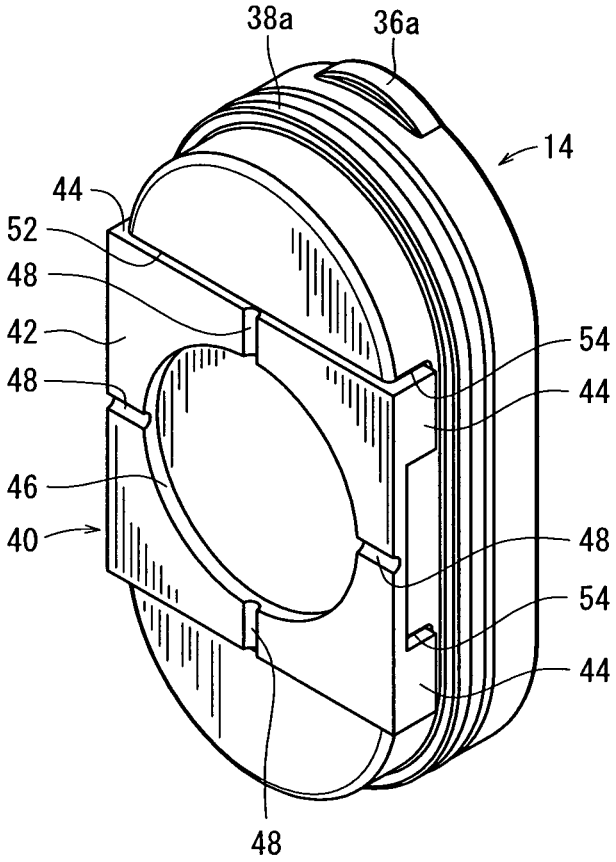
FIG. 2 is an exterior perspective view of a head cover having a first damper mounted thereon.

Further, when the first damper 40 is mounted on the head cover 14, the legs 44 project outward slightly from the side surfaces of the head cover 14 (see FIG. 2).

As shown in FIGS. 7 to 10, the rod cover 16 is formed, for example, from a metallic material such as aluminum or the like, and is installed onto the other end side (in the direction of the arrow B) of the cylinder tube 12 (see FIG. 1). Similar to the head cover 14, the rod cover 16 is formed with an elliptical shape in cross section corresponding to the shape of the cylinder hole 20.

Figure 8:
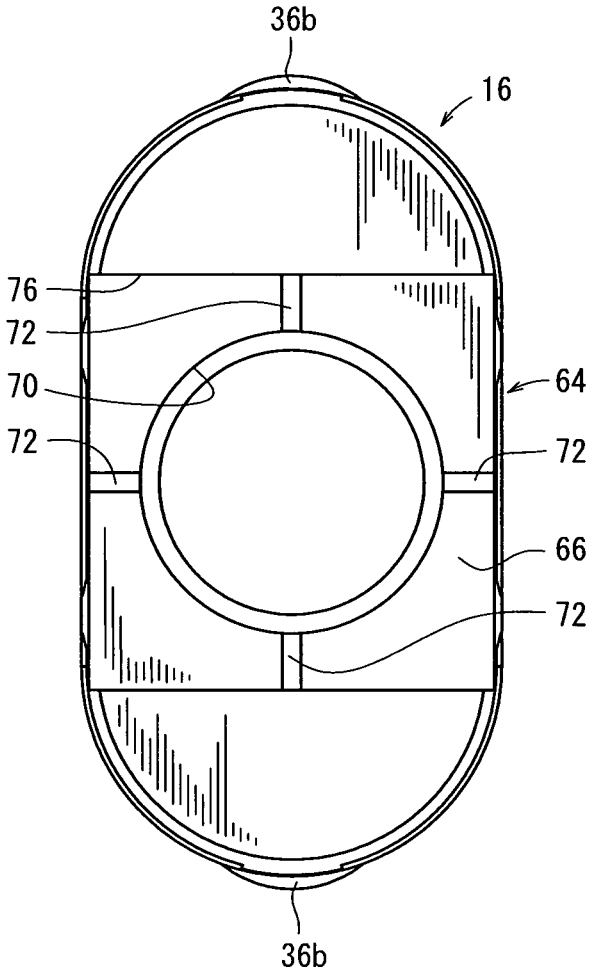
FIG. 8 is a frontal surface view of the rod cover shown in FIG. 7.

As shown in FIG. 8, on both side parts of the rod cover 16, a pair of protrusions 36*b* are formed, which project a predetermined length from the outer peripheral surface at positions corresponding to the recesses 12*b* when the rod cover 16 is installed into the cylinder hole 20. The protrusions 36*b* are disposed on both side portions that are expanded outwardly in arcuate shapes on the rod cover 16, and bulge at a given radius of curvature corresponding to the recesses 12*b*.

Further, a rod hole 56 that penetrates in the axial direction is formed in a substantially central part of the rod cover 16. A piston rod 58 connected to the piston 18 is inserted through the rod hole 56. As shown in FIG. 1, inside the rod hole 56, a rod packing 60 and a bush 62 are installed, wherein by making sliding contact with the outer circumferential surface of the piston rod 58, the piston rod 58 is supported, while a hermetic (airtight) condition of the interior of the cylinder hole 20 is maintained.

Further, an o-ring 38*b* is installed on the outer peripheral surface of the rod cover 16 via an annular groove. When the rod cover 16 is installed into the cylinder hole 20 of the cylinder tube 12, an airtight condition is maintained by abutment of the o-ring 38*b* against the inner peripheral surface of the cylinder hole 20.

On the other hand, a second damper (damper) 64 is mounted on another end portion of the rod cover 16 that faces toward the cylinder hole 20. The second damper 64 is formed, for example, from an elastic material such as rubber or the like or from a resin material, and comprises a main body portion 66 in the form of a plate having a constant thickness, which is mounted on the other end surface of the rod cover 16, and a plurality of legs (retaining members) 68, which are joined substantially perpendicularly with respect to the main body portion 66 and are retained on the rod cover 16.

The main body portion 66 is formed in a substantially flat state and includes a hole 70 with a predetermined radius formed in a center part thereof, together with substantially cross-shaped grooves 72, which are formed about the hole 70 as their center. The grooves 72 are formed on a side of one end surface of the main body portion 66 against which the piston 18 is capable of abutment, four of which are formed at 90° intervals with respect to the center of the hole 70, extending from the outer circumferential side of the hole 70 to the side edges of the main body portion 66. The form and number of the grooves 72 is not limited, insofar as the grooves 72 are connected between the side edges of the main body portion 66 and the hole 70.

The legs 68 are disposed respectively and individually in the vicinity of the four corners of the rectangular shaped main body portion 66. The legs 68 are formed so as to project by a predetermined length with respect to the other end surface of the main body portion 66.

More specifically, two legs 68 from among the four legs 68 are disposed on one side surface of the main body portion 66 while being separated by a predetermined distance, whereas the remaining two legs 68 are disposed on the other side surface of the main body portion 66 while also being separated by a predetermined distance. That is, the two pairs of legs 68 confront one another while sandwiching the main body portion 66 therebetween.

Claw portions 74, which are bent substantially perpendicularly toward directions that mutually approach each other, are provided on the ends of the legs 68. That is, the claw portions 74 are disposed in parallel, and are separated by a given distance, by the length of the legs 68, with respect to the main body portion 66.

Figure 9:
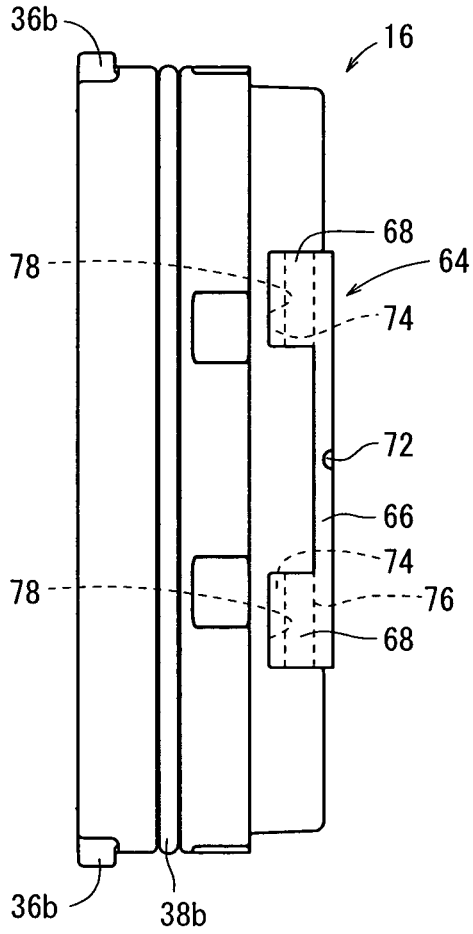
FIG. 9 is a side surface view of the rod cover shown in FIG. 7.

On the other end portion of the rod cover 16 on which the second damper 64 is mounted, a recess 76 is formed, of which a substantially center portion thereof is recessed in a rectangular shape, such that the main body portion 66 is mountable within the recess 76. Because the depth of the recess 76 is set to be narrower than the thickness of the main body portion 66, as shown in FIG. 9, a portion of the main body portion 66 projects outwardly, just slightly with respect to the other end surface of the rod cover 16. More specifically, owing to the fact that the main body portion 66 making up the second damper 64 projects outwardly from the other end surface of the rod cover 16, the piston 18 is prevented from directly contacting the rod cover 16, and shocks imparted from the piston 18 with respect to the rod cover 16 can be buffered. After the piston rod 58 has been inserted through the hole 70 of the second damper 64, the piston rod 58 is inserted through the rod hole 56 and is supported thereby.

Further, on the other end of the rod cover 16, a plurality of claw grooves (engagement grooves) 78, which are separated by a predetermined distance, are formed on the side surfaces thereof. The claw portions 74 of the legs 68 are inserted into the claw grooves 78. The number and positioning of the claw grooves 78 are set to correspond to the legs 68 and the claw portions 74 of the second damper 64.

Figure 7:
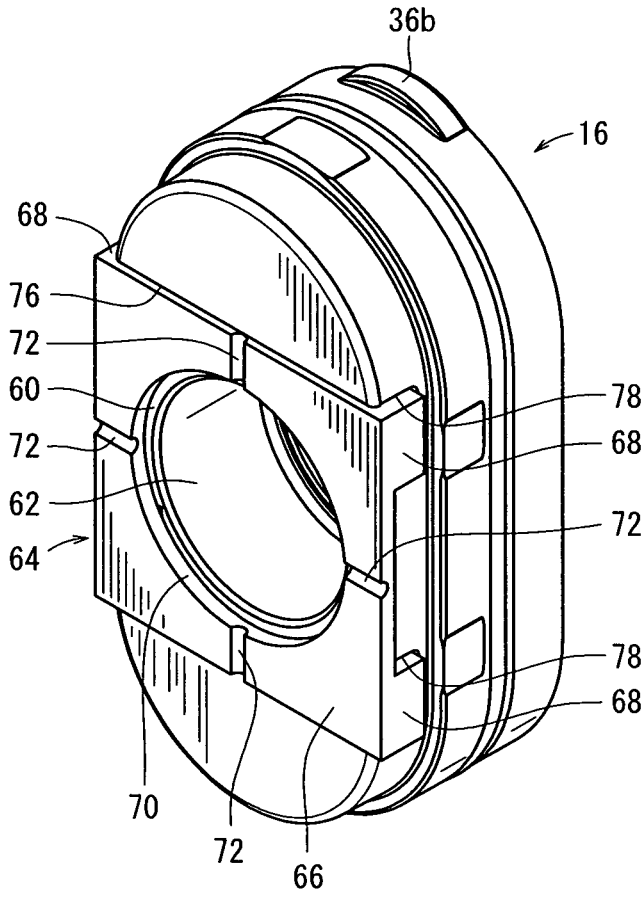
FIG. 7 is an exterior perspective view of a rod cover having a second damper mounted thereon.

Further, when the second damper 64 is mounted on the rod cover 16, the legs 68 project outward slightly from the side surfaces of the rod cover 16 (see FIG. 7).

Additionally, as shown in FIG. 1, after the head cover 14 and the rod cover 16 have been installed with respect to the cylinder hole 20 of the cylinder tube 12, latching rings 24*a*, 24*b* are installed respectively into ring grooves 22*a*, 22*b*, which are formed in the cylinder hole 20. Consequently, the head cover 14 and the rod cover 16 become affixed with respect to the cylinder tube 12 through means of the protrusions 36*a*, 36*b* and the latching rings 24*a*, 24*b*. At this time, the head cover 14 and the rod cover 16 do not project outwardly from the end surfaces of the cylinder tube 12, and the first and second dampers 40, 64 are arranged so as to face respectively toward the piston 18 (see FIG. 1).

As shown in FIGS. 1 and 12 through 14, the piston 18 is formed with a substantially elliptical shape in cross section. A piston packing 80 is installed onto the outer peripheral surface of the piston 18 via an annular groove, and together therewith, magnetic bodies 84 are mounted respectively into installation holes 82, which are provided in plurality along the circumferential direction thereof.

The installation holes 82 are provided in a quantity that is the same as the quantity of sensor grooves 34*a* to 34*d* provided on the cylinder tube 12. The installation holes 82 are formed with fan-shaped configurations in cross section, which expand gradually toward the outer circumferential surface of the piston 18, and are formed with predetermined lengths, respectively, along the axial direction of the piston 18. In addition, the rod-shaped magnetic bodies 84 are installed into the installation holes 82, and the plural installation holes 82 having the magnetic bodies 84 installed therein are covered in an integral fashion by a piston cover 86.

The piston cover 86 is formed, for example, from a resin material, in an annular form having a substantially elliptical shape in cross section corresponding to the cross sectional shape of the piston 18. Further, the piston cover 86 has an opening portion, and is formed to be expandable in a radial direction. Additionally, when the piston cover 86 is mounted into an installation groove 18*a* formed in the outer circumferential surface of the piston 18, the outer circumferential surface of the piston cover 86 is aligned substantially along the same surface with the outer circumferential surface of the piston 18.

When the piston 18 is installed into the cylinder hole 20 of the cylinder tube 12, the magnetic bodies 84 are disposed at positions corresponding to the sensor grooves 34*a* to 34*d*.

Further, a piston hole 88 that penetrates along the axial direction (the direction of arrows A and B) is formed through an inner portion of the piston 18, and a connecting part 90 of the piston rod 58 is inserted through the piston hole 88. The piston hole 88 includes an expanded diameter portion on the side of the head cover 14 (in the direction of the arrow A), such that, by the connecting part 90 of the piston rod 58 being caulked and engaged with respect to the expanded diameter portion, the piston 18 is fixedly latched onto a stepped portion 92 of the piston rod 58, and is connected integrally with the piston rod 58.

The fluid pressure cylinder 10 according to the embodiment of the present invention is constructed basically as described above. Next, operations and effects of the fluid pressure cylinder 10 shall be described.

First, explanations shall be made concerning mounting of the first and second dampers 40, 64 respectively onto the head cover 14 and the rod cover 16, and installation of the head cover 14 and the rod cover 16 onto the cylinder tube 12.

Figure 5:
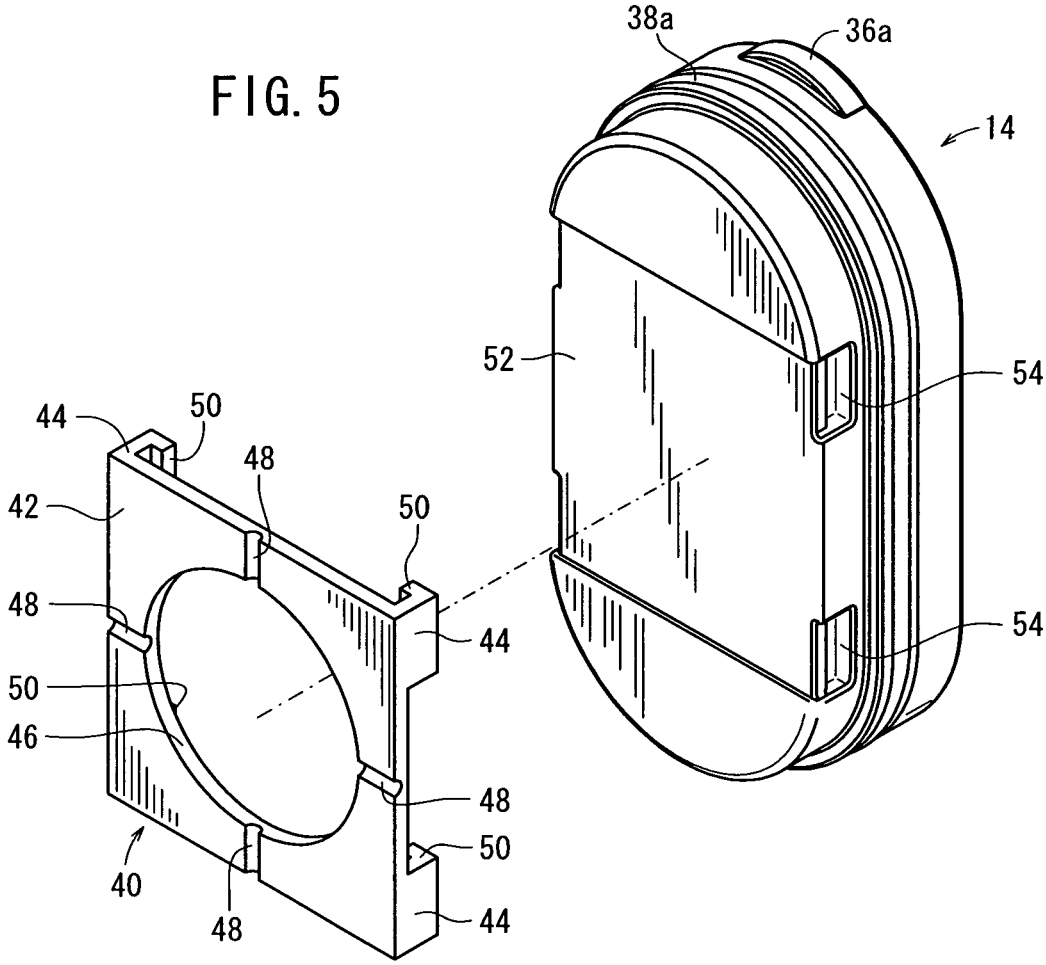
FIG. 5 is an exploded perspective view illustrating a state in which the first damper is detached and separated from the head cover of FIG. 2.
Figure 6:
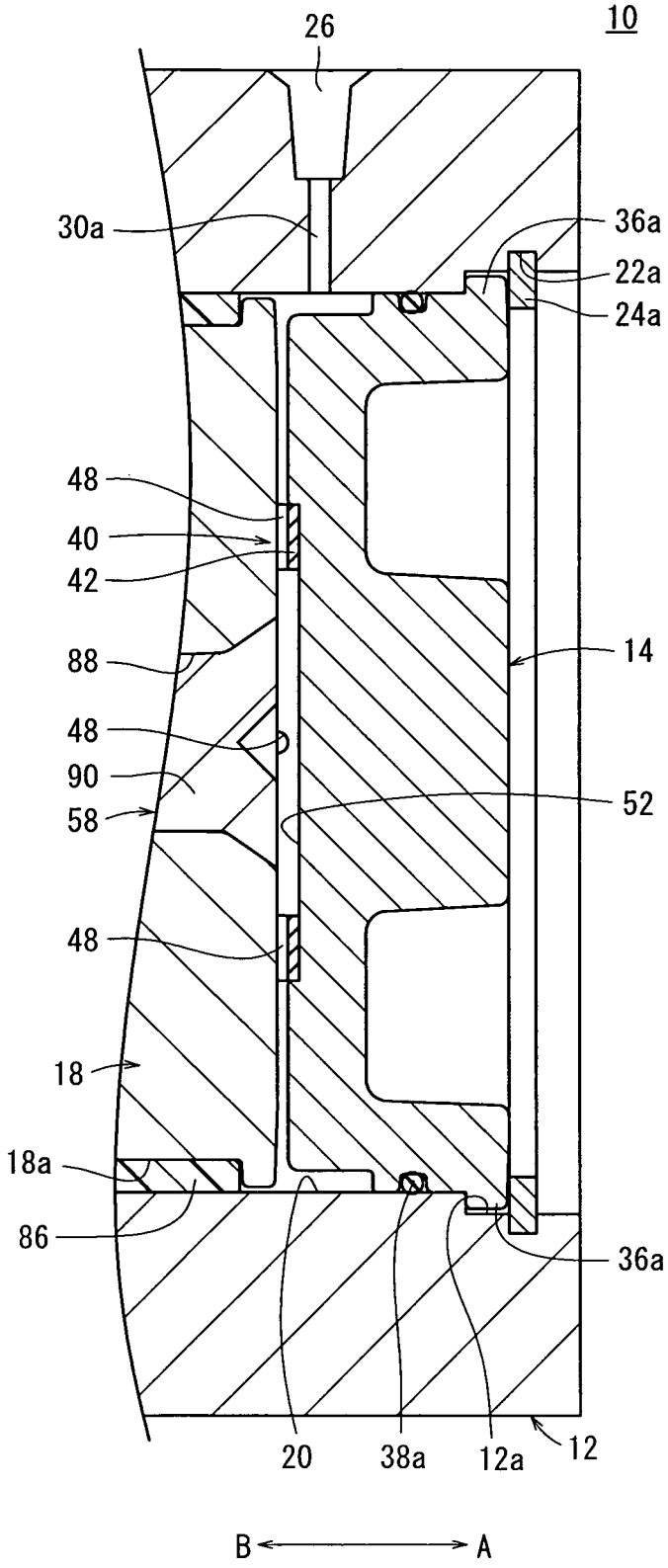
FIG. 6 is an enlarged cross sectional view showing a vicinity of the head cover of the fluid pressure cylinder of FIG. 1.
Figure 10:
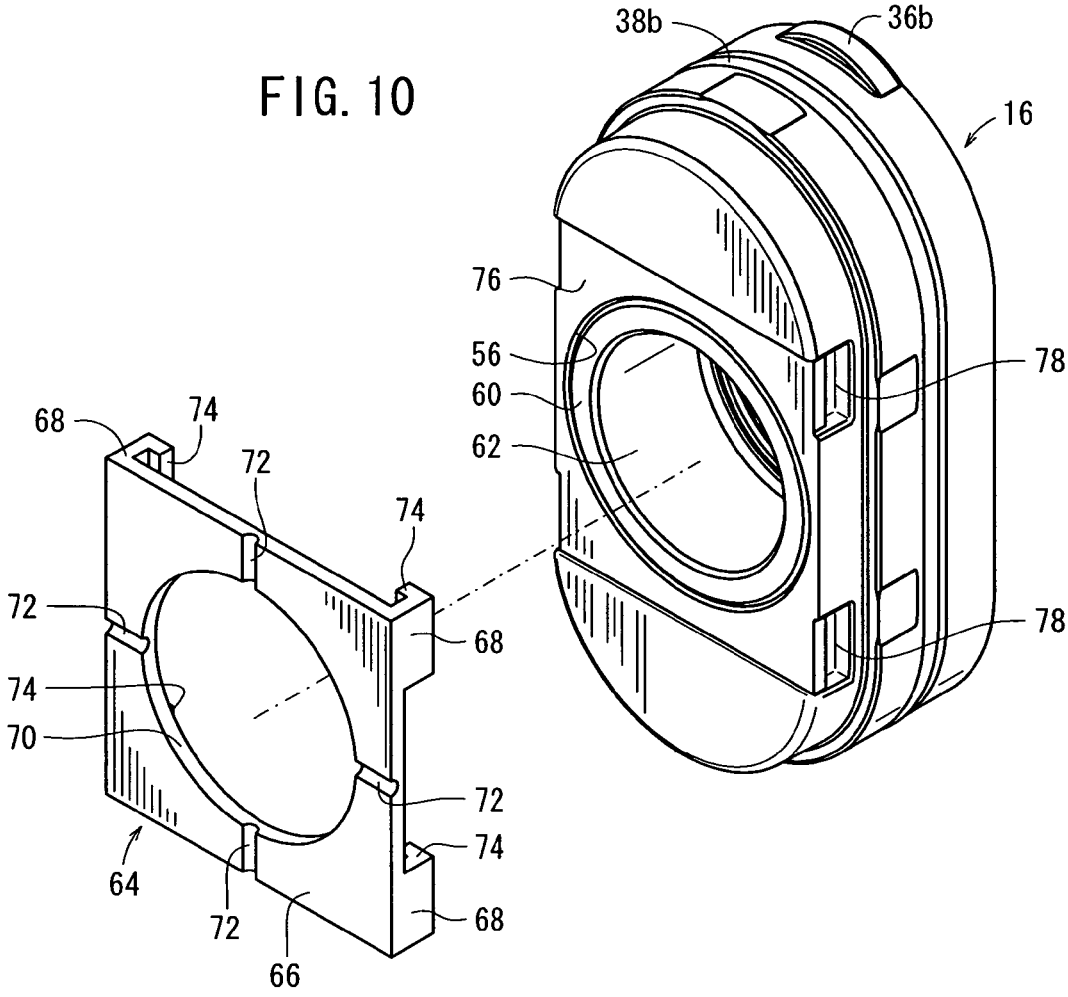
FIG. 10 is an exploded perspective view illustrating a state in which the second damper is detached and separated from the rod cover of FIG. 7.

Initially, as shown in FIGS. 5 and 10, the legs 44, 68 of the first and second dampers 40, 64 are positioned on sides of the head cover 14 and the rod cover 16, and are brought into proximity toward the sides of the head cover 14 and the rod cover 16, respectively.

Additionally, the four legs 44, 68 are mounted respectively with respect to the head cover 14 and the rod cover 16, into the claw grooves 54, 78 thereof, while the main body portions 42, 66 are inserted into the recesses 52, 76 provided on the end faces of the head cover 14 and the rod cover 16. In this case, because the widths of the main body portions 42, 66 are set somewhat larger than the widths of the recesses 52, 76, the main body portions 42, 66 project outwardly with respect to the end faces.

Further, the claw portions 50, 74 provided on the legs 44, 68 are inserted into and engage with the claw grooves 54, 78 of the head cover 14 and the rod cover 16. Owing thereto, the first and second dampers 40, 64 are retained integrally in close contact with the head cover 14 and the rod cover 16, in a state in which the main body portions 42, 66 are inserted into the recesses 52, 76, the legs 44, 68 are attached tightly to the side surfaces, and the claw portions 50, 74 are engaged with the claw grooves 54, 78.

In this manner, by engagement of the claw portions 50, 74 provided on the plural legs 44, 68 with respect to the claw grooves 54, 78 formed in the side surfaces of the head cover 14 and the rod cover 16, respectively, the first and second dampers 40, 64 can be installed easily, in a state of tight attachment and close contact with the head cover 14 and the rod cover 16.

Next, in the case that the head cover 14 and the rod cover 16 having the first and second dampers 40, 64 mounted thereon are installed onto both ends of the cylinder tube 12, the first and second dampers 40, 64 are arranged to face toward respective sides of the cylinder tube 12, while the head cover 14 and the rod cover 16 are inserted into the interior of the cylinder hole 20. In addition, after the projections 36*a*, 36*b* of the head cover 14 and the rod cover 16 have become engaged respectively with the recesses 12*a*, 12*b* of the cylinder hole 20 and positioned thereby, by inserting the latching rings 24*a*, 24*b* respectively into the ring grooves 22*a*, 22*b*, the head cover 14 and the rod cover 16 are affixed onto both ends of the cylinder tube 12.

At this time, the legs 44, 68 constituting the first and second dampers 40, 64 are sandwiched and gripped between the side surface of the head cover 14 and the rod cover 16 and the inner wall surface of the cylinder hole 20. Consequently, the legs 44, 68 are retained and affixed strongly, respectively, between the head cover 14 and the cylinder tube 12, and between the rod cover 16 and the cylinder tube 12. As a result, in a condition where the head cover 14 and the rod cover 16 are installed into both ends of the cylinder tube 12, the first and second dampers 40, 64 are reliably fixed in place and are prevented from falling off from the head cover 14 and the rod cover 16 into the cylinder hole 20 of the cylinder tube 12.

Next, operations and effects of the fluid pressure cylinder 10, including the head cover 14 and the rod cover 16 onto which the first and second dampers 40, 64 have been mounted in the foregoing manner, shall be described. A condition wherein the piston 18 is displaced toward the side of the head cover 14 (in the direction of the arrow A), as shown in FIG. 1, shall be described as an initial position.

First, in the initial position, a pressure fluid from a pressure fluid supply source (not shown) is introduced into the first fluid port 26. In this case, the second fluid port 28 is placed in a state of being open to atmosphere, through the switching action of a non-illustrated directional control valve. As a result, the pressure fluid is introduced from the first fluid port 26 to the interior of the cylinder hole 20 through the communication passage 30*a*, and the piston 18 is pressed toward the side of the rod cover 16 (in the direction of the arrow B) by the pressure fluid, which is introduced between the head cover 14 and the piston 18. In addition, by abutment of the end surface of the piston 18 against the main body portion 66 of the second damper 64 mounted on the other end side of the rod cover 16, a displacement terminal end position, at which the displacement of the piston 18 is regulated, is reached.

At this time, shocks generated by abutment of the piston 18 against the second damper 64 are buffered, and such shocks are prevented from being imparted with respect to the piston 18 and the rod cover 16.

Further, in this case, there is a concern that the second damper 64 will be pressed and crushed under an abutment action of the piston 18, and the main body portion 66 will become deformed, expanding in a widthwise direction perpendicular to the axis of the rod cover 16. However, because the legs 68 provided in the vicinity of the four corners of the main body portion 66 are gripped between the cylinder tube 12 and the rod cover 16, the second damper 64 does not separate from the rod cover 16 and is suitably retained thereby. That is, even upon abutment of the piston 18, the second damper 64 does not fall off from the rod cover 16.

Furthermore, as a result of the sensors 32, which are installed in the sensor grooves 34*a* to 34*d* of the cylinder tube 12, detecting the magnetism of the magnetic bodies 84 mounted in the piston 18, arrival of the piston 18 at the displacement terminal end position is confirmed. More specifically, by disposing at least one from among the plural sensors 32 beforehand at a position confronting a magnetic body 84 of the piston 18 at the displacement terminal end position, by means of the sensor 32, the displacement terminal end position of the piston 18 can be detected.

On the other hand, in the case that the piston 18 is displaced in an opposite direction (the direction of the arrow A), the pressure fluid is supplied to the second fluid port 28, while the first fluid port 26 is opened to atmosphere under a switching action of the directional control valve (not shown). In addition, the pressure fluid is supplied from the second fluid port 28 to the interior of the cylinder hole 20 through the communication passage 30*b*, and the piston 18 is pressed toward the side of the head cover 14 (in the direction of the arrow A) by the pressure fluid, which is introduced between the rod cover 16 and the piston 18.

Concerning the end surface of the piston 18, portions thereof are not abutted with respect to the main body portion 66 by the hole 70 and the plural grooves 72 that are provided on the main body portion 66. Owing thereto, when the end surface of the piston 18 separates away from the main body portion 66 of the second damper 64, the end surface of the piston 18 that was in close contact with the main body portion 66 can be suitably disengaged therefrom, through the spaces of the hole 70 and the grooves 72.

In addition, by displacement of the piston 18, the piston rod 58 is displaced integrally therewith toward the side of the head cover 14 (in the direction of the arrow A), wherein by abutment of the end surface of the piston 18 against the first damper 40, which is mounted on the other end side of the head cover 14, the displacement of the piston 18 is restored to its regulated initial position (see FIG. 1).

In this case as well, in a similar manner, shocks that are generated upon abutment of the piston 18 are absorbed and buffered by the first damper 40, and such shocks are prevented from being imparted with respect to the piston 18 and the head cover 14.

Further, in this case, there is a concern that the first damper 40 will be pressed and crushed under an abutment action of the piston 18, and the main body portion 42 will become deformed, expanding in a widthwise direction perpendicular to the axis of the head cover 14. However, because the legs 44 provided in the vicinity of the four corners of the main body portion 42 are gripped between the cylinder tube 12 and the head cover 14, the first damper 40 does not separate from the head cover 14 and is suitably retained thereby. That is, even upon abutment of the piston 18, the first damper 40 does not fall off from the head cover 14.

Furthermore, as a result of the sensors 32, which are installed in the sensor grooves 34*a* to 34*d* of the cylinder tube 12, detecting the magnetism of the magnetic bodies 84 mounted in the piston 18, arrival of the piston 18 at the initial position is confirmed. More specifically, by disposing another sensor 32, apart from the sensor 32 that is arranged corresponding to the displacement terminal end position of the piston 18, beforehand at a position confronting a magnetic body 84 of the piston 18 at its initial position, by means of such a sensor 32, the fact that the piston 18 is at its initial position can be detected.

In the present embodiment as described above, owing to the structure in which four magnetic bodies 84 are disposed on the piston 18, and four sensor grooves 34*a* to 34*d* are provided on the cylinder tube 12, the displacement of the piston 18 can be detected at a maximum of four positions by arranging the sensors 32 at respective desired positions in the sensor grooves 34*a* to 34*d*.

In the foregoing manner, according to the present embodiment, first and second dampers 40, 64 made for example from an elastic material are mounted on the end surfaces of the head cover 14 and the rod cover 16 facing toward the piston 18. The main body portions 42, 66 of the first and second dampers 40, 64 are arranged to face toward the piston 18, and the plural legs 44, 68 that are joined to the main body portions 42, 66 are installed onto the side surfaces of the head cover 14 and the rod cover 16, while the head cover and the rod cover 16 are mounted respectively onto the ends of the cylinder tube 12.

Consequently, by installation of the head cover 14 and the rod cover 16 onto the cylinder tube 12, since the legs 44, 68 of the first and second dampers 40, 64 are retained reliably between the head cover 14 and the rod cover 16 and the cylinder tube 12, the first and second dampers 40, 64 do not fall off into the cylinder hole 20, and thus the shock absorbing function of the piston 18 can be carried out by the first and second dampers 40, 64.

Further, because the first and second dampers 40, 64 can be assembled easily with respect to the other ends of the head cover 14 and the rod cover 16, the ability to assemble (ease of assembly) of the fluid pressure cylinder 10 including the first and second dampers 40, 64 can be improved.

Furthermore, installation holes 82 into which the magnetic bodies 84 can be installed are provided on the outer peripheral surface of the piston 18, and after the magnetic bodies 84 have been installed into the installation holes 82, the magnetic bodies 84 can be easily and reliably mounted with respect to the piston 18 by covering them with the piston cover 86. Stated otherwise, because the magnetic bodies 84 are covered by the piston cover 86, the magnetic bodies 84 are prevented from falling out from the piston 18. Further, by manufacturing the piston 18, for example, through die casting, the plurality of installation holes 82 can be formed easily on the outer peripheral surface of the piston 18.

The fluid pressure cylinder according to the present invention is not limited to the above-described embodiment, and various other structures can be adopted as a matter of course without deviating from the essence and gist of the present invention.

The invention claimed is:

1. A fluid pressure cylinder comprising:

a cylinder body having a cylinder chamber defined therein;

a piston that is disposed displaceably along an axial direction inside the cylinder chamber;

a cover member accommodated inside the cylinder chamber that blocks and seals the cylinder chamber, a side of the cover member that faces toward the piston including a recess that extends across a width of the cover member from an outer edge of the cover member to an opposing outer edge of the cover member; and a damper disposed on the cover member, which absorbs shocks when the piston abuts against the cover member, the damper being formed from:

a main body portion that faces toward the piston and is disposed in the recess; and a retaining member that extends perpendicularly to the main body portion and is engaged with a side surface of the cover member, wherein the retaining member is gripped between the side surface of the cover member and an inner wall surface of the cylinder body.

2. The fluid pressure cylinder according to claim 1, wherein the retaining member includes a claw portion, which projects outwardly with respect to the retaining member, the claw portion being inserted into an engagement groove formed on a side surface of the cover member.

3. The fluid pressure cylinder according to claim 2, wherein the main body portion includes a groove on a surface thereof against which the piston abuts.

4. The fluid pressure cylinder according to claim 3, wherein the retaining member comprises a plurality of retaining members disposed on a side portion of the main body portion.

5. The fluid pressure cylinder according to claim 4, wherein the retaining members are gripped between the cylinder body and the cover member when the cover member is installed with respect to the cylinder body.

6. The fluid pressure cylinder according to claim 3, wherein the groove is formed substantially in the shape of a cross with respect to the main body portion.

7. The fluid pressure cylinder according to claim 1, wherein the main body portion is formed in a substantially rectangular shape and includes a hole in a center portion thereof.

8. The fluid pressure cylinder according to claim 1, wherein the main body portion is mounted in a recess of the cover member facing the piston, and is disposed to project outwardly with respect to an end surface of the cover member.

9. The fluid pressure cylinder according to claim 1, wherein a width of the main body portion is greater than a width of the recess, and a depth of the recess is less than a thickness of the main body portion.

10. The fluid pressure cylinder according to claim 1, wherein an entire length of the retaining member extending perpendicularly to the main body portion is gripped between the side surface of the cover member and an inner wall surface of the cylinder body.

11. The fluid pressure cylinder according to claim 1, wherein the piston includes a magnet disposed in a hole in a side of the piston, and the piston includes a piston cover that is expandable and is fitted around a perimeter of the piston so that the piston cover prevents the magnet from falling out of the hole.

12. The fluid pressure cylinder according to claim 11, wherein the cylinder body includes a sensor disposed on the cylinder body, and the sensor detects a position of the magnet disposed in the hole in the piston.

* * * * *